US006258520B1

(12) United States Patent
Yau et al.

(10) Patent No.: US 6,258,520 B1
(45) Date of Patent: Jul. 10, 2001

(54) HYDROLYZED WATER-RESISTANT PROTECTIVE OVERCOAT FOR AN IMAGING ELEMENT

(75) Inventors: Hwei-Ling Yau; Thomas H. Whitesides, both of Rochester; Elmer C. Flood, Canandaigua; Amy E. Jasek, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/675,833

(22) Filed: Sep. 29, 2000

Related U.S. Application Data

(62) Division of application No. 09/547,374, filed on Apr. 11, 2000.

(51) Int. Cl.[7] ..... G03C 11/08; G03C 11/06; G03C 1/76; G03C 5/305; G03C 5/38

(52) U.S. Cl. ..... 430/527; 430/536; 430/537; 430/350; 430/432; 430/448; 430/463; 430/455; 430/461; 430/486; 430/493; 430/961

(58) Field of Search ..... 430/536, 537, 430/350, 961, 463, 493, 432, 448, 539, 248, 205, 455, 461, 486, 527

(56) References Cited

U.S. PATENT DOCUMENTS

| | | | | |
|---|---|---|---|---|
| 3,565,618 | * | 2/1971 | Marechal | 430/252 |
| 4,567,131 | * | 1/1986 | Watkiss | 430/205 |
| 5,853,926 | | 12/1998 | Bohan et al. | 430/537 |
| 5,856,051 | | 1/1999 | Yau et al. | 430/537 |
| 5,866,312 | * | 2/1999 | Wang et al. | 430/537 |
| 5,910,391 | * | 6/1999 | Kondo et al. | 430/248 |
| 5,958,658 | * | 9/1999 | Smith et al. | 430/537 |

* cited by examiner

*Primary Examiner*—Richard L. Schilling
(74) *Attorney, Agent, or Firm*—Chris P. Konkol

(57) ABSTRACT

The present invention relates to imaging elements, including photographic elements and recording media, having a protective overcoat that resists fingerprints, common stains, and spills. More particularly, the present invention provides a processing-solution-permeable protective overcoat that is water resistant in the final processed product. The overcoat, before formation of the image, comprises hydrophobic polymeric particles in a gelatin matrix. Subsequent treatment of the overcoat, after formation of the image, to remove the gelatin, causes coalescence of the hydrophobic particles, resulting in the formation of a water-resistant continuous protective overcoat.

9 Claims, No Drawings

HYDROLYZED WATER-RESISTANT PROTECTIVE OVERCOAT FOR AN IMAGING ELEMENT

CROSS-REFERENCE TO RELATED APPLICATION

This is a Divisional of application Ser. No. U.S. 09/547,374 filed Apr. 11, 2000, now allowed.

FIELD OF THE INVENTION

The present invention relates to photographic elements having a protective overcoat that resists fingerprints, common stains, and spills. More particularly, the present invention provides a processing-solution-permeable protective overcoat that is water resistant in the final processed product. The overcoat, before formation of the image, comprises hydrophobic polymeric particles in a gelatin matrix. Subsequent treatment of the overcoat, after formation of the image, to remove the gelatin, causes coalescence of the hydrophobic particles, resulting in the formation of a water-resistant continuous protective overcoat.

BACKGROUND OF THE INVENTION

Gelatin has been used extensively in a variety of imaging elements as the binder because of its many unique and advantageous properties. For example, its property of water swellability allows processing chemistry to be carried out to form silver halide-based photographic images, and its hydrophilic nature allows gelatin to function as an ink-receiver in ink-jet recording media. However, due to this same property, imaging elements with exposed gelatin-containing materials, no matter if they are formed on transparent or reflective media, have to be handled with extreme care so as not to be in contact with any aqueous solutions that may damage the images. Accidental spillage of common household solutions such as coffee, punch, or even plain water can damage imaging elements such as photographic prints.

There have been attempts over the years to provide protective layers for gelatin-based photographic systems that will protect the images from damage by water or aqueous solutions. U.S. Pat. No. 2,173,480 describes a method of applying a colloidal suspension to moist film as the last step of photographic processing before drying. A number of patents describe methods of solvent coating a protective layer on the image after photographic processing is completed and are described, for example, in U.S. Pat. Nos. 2,259,009, 2,331,746, 2,798,004, 3,113,867, 3,190,197, 3,415,670 and 3,733,293. More recently, U.S. Pat. No. 5,376,434 describes a protective layer formed on a photographic print by coating and drying a latex on a gelatin-containing layer bearing an image. The latex is a resin having a glass transition temperature of from 30 ° C. to 70 ° C. Another type of protective coating involves the application of UV-polymerizable monomers and oligomers on a processed image followed by radiation exposure to form crosslinked protective layer, which is described in U.S. Pat. Nos. 4,092,173, 4,171,979, 4,333,998 and 4,426,431. A drawback for both the solvent coating method and for the radiation cure method is the health and environmental concern of those chemicals or radiation to the coating operator. Another drawback is that the photographic materials need to be coated after the processing step. Thus, the processing equipment needs to be modified and the personnel running the processing operation need to be trained to apply the protective coating.

Various lamination techniques are known and practiced in the trade. U.S. Pat. Nos. 3,397,980, 3,697,277 and 4,999,266 describe methods of laminating a polymeric sheet film, as a protective layer, on a processed image. Protective coatings that need to be applied to the image after it is formed, several of which were mentioned above, add a significant cost to the final imaged product. A number of patents have been directed to water-resistant protective coatings that can be applied to a photographic element prior to development. For example, U.S. Pat. No. 2,706,686 describes the formation of a lacquer finish for photographic emulsions, with the aim of providing water- and fingerprint-resistance by coating the light-sensitive layer, prior to exposure, with a porous layer that has a high degree of water permeability to the processing solutions. After processing, the lacquer layer is fused and coalesced into a continuous, impervious coating. The porous layer is achieved by coating a mixture of a lacquer and a solid removable extender (ammonium carbonate), and removing the extender by sublimation or dissolution during processing. The overcoat as described is coated as a suspension in an organic solvent, and thus is not desirable for large-scale application. More recently, U.S. Pat. No. 5,853,926 to Bohan et al. discloses a protective coating for a photographic element, involving the application of an aqueous coating comprising polymer particles and a soft polymer latex binder. This coating allows for appropriate diffusion of photographic processing solutions, and does not require a coating operation after exposure and processing. Again, however, the hydrophobic polymer particles must be fused to form a protective coating that is continuous and water-impermeable.

The ability to provide the desired property of post-process water/stain resistance of an imaged photographic element, at the point of manufacture of the photographic element, is a highly desired feature. However, in order to accomplish this feature, the desired photographic element should be permeable to aqueous solutions during the processing step, but after processing achieve water resistance and even water impermeability for at least some time after contact with water. Commonly assigned U.S. Ser. No. 09/235,436 discloses the use of a processing solution permeable overcoat that is composed of a urethane-vinyl copolymer having acid functionalities. Commonly assigned U.S. Ser. No. 09/235,437 and U.S. Ser. No. 09/448,213 (Docket 80220) disclose the use of a second polymer such as a soluble gelatin or polyvinyl alcohol to improve permeability.

U.S. Pat. No. 5,856,051 describes the use of hydrophobic particles with gelatin as the binder in an overcoat formulation. This invention demonstrated an aqueous coatable, water-resistant protective overcoat that can be incorporated into the photographic product, allows for appropriate diffusion of photographic processing solutions, and does not require a coating operation after exposure and processing. The hydrophobic polymers exemplified in U.S. Pat. No. 5,856,051 include polyethylene having a melting temperature (Tm) of 55 to 200° C., and therefore capable of forming a water-resistant layer by fusing the layer at a temperature higher than the Tm of the polymer after the sample has been processed to generate the image. The coating solution is aqueous and can be incorporated in the manufacturing coating operation without any equipment modification. The fusing step is simple and environmentally friendly to photofinishing laboratories. Since the particles are incorporated entirely within the uppermost layer, this approach does not suffer from a lack of mechanical strength and integrity during transport and handling prior to image formation and fusing. However, the scratch resistance of such an overcoat after fusing is a serious concern, since polyethylene is a very soft material.

Similarly, commonly assigned U.S. Ser. No. 09/353,939 (Docket 79581) and U.S. Ser. No. 09/548,514 filed Apr. 13, 2000 (docket 80493), respectively, describe the use of a polystyrene-based material and a polurethane-based material, with gelatin as the binder, in an overcoat for a photographic element, which overcoat can be fused into a water resistant overcoat after photographic processing is accomplished to generate an image.

Therefore, there remains a need for, and it would be highly desirable to obtain, an overcoat applied to a photographic element before development that would not significantly reduce the rate of reaction of the developer with the underlying emulsions, but which would ultimately provide a water resistant and durable overcoat after the processing or developing step. Furthermore, there is a need for a commercially viable water-resistant coating that can be applied to an photographic element prior to exposure and which is permeable to water during development and which becomes relatively impermeable to water in the final product without necessitating a fusing step.

SUMMARY OF THE INVENTION

The present invention provides a gelatin-based aqueous-coatable protective overcoat that can be coated onto the imaging element and allows for appropriate diffusion of photographic processing solutions. The overcoat is applied to the imaging element as a composition comprising 10 to 50% by weight gelatin and 50 to 90% by weight of hydrophobic particles (by weight of dry laydown of the entire overcoat) having an average diameter of 10 to 500 nm. The gelatin in the overcoat layer is subsequently digested or hydrolyzed by one or more proteolytic enzymes, leading to a gelatin-free water-resistant protective overcoat with good scratch resistance, whereby the hydrophobic particles have coalesced or otherwise forms a film that provides water resistance. This method is applicable to a wide selection of materials chosen for their performance as protective overcoat.

Following enzyme digestion of gelatin the overcoat, the hydrophobic particles may or may not require fusing depending on its composition. In one embodiment, the hydrophobic particles comprise a polymer selected to have a $T_g$ less than 55° C., preferably less than 50° C. and a molecular weight less than 100,000, preferably less 50,000, such that the particles are capable of forming an impermeable film without heat or pressure fusing. In other embodiments, the overcoat may require fusing or extensive heating. However, a tradeoff for the fusing is that the hydrophobic particles may be selected to provide properties in the protective overcoat not otherwise obtainable, for example, better barrier properties to a wider selection of spill types.

The use of gelatin in the present overcoat provides manufacturing coatability and allows photographic processing. The hydrophobic material can be introduced to the overcoat coating melt in a latex form or as a conventional colloidal dispersion in gelatin, the particle size of particles preferred to be from 10 nm to 500 nm, more preferable to be from 30 nm to 250 nm.

In the context of a photographic element, the gelatin in the overcoat can be removed by one of the following methods, leading to a relatively gelatin-free hydrophobic layer.

(1) A proteolytic enzyme is added in any one of the photographic processing solutions (e.g. developer, bleach, fix or blix) or in the wash tank at a concentration to by hydrolyze the gelatin in the overcoat layer sufficiently to solubilize in the processing solution. A hydrophobic layer is formed when the photographic product of this invention is dried by the dryer at the end of the photographic processing. Optionally, a high efficiency dryer or fuser can be used to speed, promote, or further complete the film formation process, depending on the hydrophobic material of choice used in the overcoat layer.

(2) An additional tank is added to the processor, which contains a solution of proteolytic enzyme, separate and different from the existing process solutions. The location of this tank can be either prior to developer or after any of the existing tanks. A hydrophobic layer is formed when the photographic product of this invention is dried by the dryer attached to the end of the photographic processing. Optionally, a high efficiency dryer or fuser can be used to promote/further complete film formation process, depending on the hydrophobic material of choice used in the overcoat layer.

(3) Photographic products, after processing to develop images and drying, is immersed in a proteolytic enzyme solution to remove the gelatin in the overcoat layer, followed by appropriate drying to convert the gelatin-free overcoat layer to a water-resistant protective overcoat layer. Optionally, a fuser can be used subsequently to promote/further complete film formation process by the combination of heat and pressure, depending on the hydrophobic material of choice used in the overcoat layer.

By the term "fusing" herein is meant the combination of pressure and heat wherein the heat is applied at a temperature of from 35 to 175° C., typically with a pressure roller or belt. In each of the three approaches above, the enzyme concentration is dependent on the type of enzyme used, solution properties such as pH, ionic strength, temperature, and other factors that affect enzyme activity and the time allowed for the emulsion to be immersed in the enzyme solution. Optionally, stabilizers are used to maintain constant enzyme activity in solution for extended period of time.

Hence, the present invention provides an imaging element comprising a protective overcoat composition over the imaging layer, as well as methods of converting this overcoat from water-permeable to water-resistant by the application of proteolytic enzymes. Finally, the invention is also directed to enzyme-containing photochemical processing solutions that can be used to make imaging elements according to the present invention.

DETAILED DESCRIPTION OF THE INVENTION

As mentioned above, the present invention provides a novel overcoat formulation for the image side of imaging elements, for example photographic prints, which encounter frequent handling and abuse by end-users. The overcoat formulation of this invention comprises 50% to 90% by weight (based on the dry laydown of the overcoat) of hydrophobic polymer particles of 10 nm to 500 nm in average size and 10% to 50% by weight (based on the dry laydown of the overcoat) of gelatin as binder. Other common addenda, such as hardeners (crosslinkers for the gelatin), speed control dyes, matte particles, spreading agents, charge control agents, dry scratch resistance compounds and lubricants can also be included in the formulation as needed.

The colloidal dispersions of hydrophobic polymers used in this invention are generally latexes or hydrophobic polymers of any composition that can be stabilized in an water-based medium. Such hydrophobic polymers are generally classified as either condensation polymer or addition polymers. Condensation polymers include, for example, polyesters, polyamides, polyurethanes, polyureas, polyethers, polycarbonates, polyacid anhydrides, and polymers comprising combinations of the above-mentioned types. Addition polymers are polymers formed from polymerization of vinyl-type monomers including, for example, allyl compounds, vinyl ethers, vinyl heterocylic compounds, styrenes, olefins and halogenated olefins, unsaturated acids and esters derived form them, unsaturated nitrites, vinyl alcohols, acrylamides and methacrylamides, vinyl ketones, multifunctional monomers, or copolymers formed from various combinations of these monomers. Such latex polymers can be prepared in aqueous media using well-known free radical emulsion polymerization methods and may consist of homopolymers made from one type of the above-mentioned monomers or copolymers made from more than one type of the above-mentioned monomers. Polymers comprising monomers which form water-insoluble homopolymers are preferred, as are copolymers of such monomers. Preferred polymers may also comprise monomers which give water-soluble homopolymers, if the overall polymer composition is sufficiently water-insoluble to form a latex. Further listings of suitable monomers for addition type polymers are found in U.S. Pat. No. 5,594,047 incorporated herein by reference. The polymer can be prepared by emulsion polymerization, solution polymerization, suspension polymerization, dispersion polymerization, ionic polymerization (cationic, anionic), Atomic Transfer Radical Polymerization, and other polymerization methods known in the art of polymerization.

In one embodiment of the invention, the hydrophobic polymer can be selected so that fusing is not required, a potentially significant advantage compared to the prior art, for example U.S. Pat. No. 5,856,051, mentioned above. It has been found that once the gelatin is hydrolyzed and degraded by proteolytic enzyme and removed during photographic processing or addition washing, selected hydrophobic particles can coalesce without fusing (which they would not do in the absence of the enzyme treatment of the gelatin). Thus, the selection of hydrophobic particles to be used in the overcoat is based on the material properties one wishes to have as the protective overcoat.

Another significant advantage of the present invention is that the coating solution for the overcoat of this invention is water-based and gels on cooling, which means that the invention can thus be incorporated in the manufacturing coating operation without any equipment modification and simultaneously with other coatings. The presence of 10–50% by weight of gelatin is sufficient to allow proper permeability for processing solution to diffuse in and out for image development. A water-resistant layer can be subsequently formed by application of proteolytic enzyme to the overcoat by one of the following methods:

(1) A proteolytic enzyme is added in any one of the photographic processing solutions (e.g. developer, bleach, fix or blix, stablizer) or in the wash tank at the concentration sufficient to hydrolyze gelatin in the overcoat layer. A hydrophobic layer is formed when the photographic product of this invention is dried by the dryer at the end of the photographic processing. Optionally, a high efficiency dryer or fuser can be used to promote/further complete film formation process, depending on the hydrophobic material of choice used in the overcoat layer.

(2) An additional tank is included in the processor, which contains a solution of proteolytic enzyme. The location of this tank can be either prior to developer or after any of the existing tank. A hydrophobic layer is formed when the photographic product of this invention is dried by the dryer at the end of the photographic processing. Optionally, a high efficiency dryer or fuser can be used to promote/further complete film formation process, depending on the hydrophobic material of choice used in the overcoat layer.

(3) Photographic products, after processing to develop images and drying, is immersed in an enzyme solution to remove the gelatin in the overcoat layer, followed by appropriate drying to convert the gelatin-free overcoat layer to a water-resistant protective overcoat layer. Optionally, a fuser can be used subsequently to promote/further complete film formation process by the combination of heat and pressure, depending on the hydrophobic material of choice used in the overcoat layer In the above approaches, the enzyme concentration is dependent on the type of enzyme used, solution properties such as pH, ionic strength, osmolality, temperature, and other factors that affect enzyme activity and the time allowed for the emulsion to be immersed in the enzyme solution. Optionally, stabilizers are used to maintain constant enzyme activity in solution for extended period of time. It will be understood that variations and modifications of these methods leading to a water resistant overcoat layer may also be employed.

Thus, one aspect of the present invention is directed to photochemical processing compositions that contain enzyme for hydrolyzing the gelatin in the overcoat The composition may be in solid form, for example tablets, capsules, powders and the like, which can be added to a conventional photoprocessing solution or form a novel photoprocessing solution. Alternatively, the photochemical processing composition may be in water-based liquid form, either a concentrated or unconcentrated solution. Such compositions, for treating a silver-halide light sensitive photographic element comprises (1) the proteolytic enzyme, (2) a photochemical selected from the group consisting of a developing agent for the imaging element, a fixing agent for removing insoluble silver halide salts, a bleaching agent for reoxidizing the silver to ionic silver state, photochemical stabilizers, or combinations thereof For example, common bleaching agent are persulfate compounds or ferric complexes of an aminocarboxylic acid. Typical fixing agents are thiosulfate or thiocyanate compounds.

Enzymes are biological catalysts. Similar to traditional chemical catalysts, enzymes speed the rate of biological reactions by producing a transition state with a lower energy of activation than the uncatalyzed reaction. In other words, enzymes are proteins specialized for the reactions they catalyze. The preferred enzymes employed in this invention are proteolytic enzymes, which catalytically hydrolyze the peptide bonds of proteins. Examples of commercially available proteolytic enzymes are HT Proteolytic 200 and Protex 6L available from Genencor International Inc., and Alcalase, ™ Savinase™ and Esperase™ available from Novo Nordisk. Other proteolytic enzymes should also be suitable for this application. Combinations of more than one enzyme can also be used.

It is desirable to formulate an enzyme solution with acceptable enzyme activity for an extended period of time. Compounds to stabilize enzyme activity of liquid proteolytic enzyme solutions are well known. A few examples are cited here for references. U.S. Pat. No. 4,238,345 describes the use of antioxidant, hydrophilic polyols and pH buffer to stabilize proteolytic enzyme used in detergents. U.S. Pat. No. 4,243,546 teaches the use of alkanolamine and an organic or inorganic acid to stabilize enzyme activity in an aqueous detergent composition. U.S. Pat. No. 4,318,818 describes an enzyme stabilizing system comprising calcium ions and a low molecular weight carboxylic acid salt, preferably with a low molecular weight alcohol and pH between 6.5 to 10. U.S. Pat. No. 4,532,064 discloses a mixture of boron compounds, reducing salt and dicarboxylic acid to stabilize enzyme in liquid detergent. U.S. Pat. No. 4,842,767 describes the use of casein to stabilize the enzyme in liquid detergent. U.S. Pat. No. 5,840,677 describes the use of boronic acid or borinic acid derivatives as enzyme stabilizers. U.S. Pat. No. 5,612,306 describes the combination of at least one chelating agent and at least one nonionic surfactant as the enzyme stabilizing system. Other means of enzyme stabilization can be found in U.S. Pat. Nos. 5,877,141, 5,904,161, U.S. Pat. Nos. 5,269,960, 5,221,495, 5,178,789, 5,039,446, 4,900,475, and the like.

There can be incorporated into the overcoat composition a dye that will impart color or tint. In addition, additives can be incorporated into the composition that will give the overcoat various desired properties. For example, a UV absorber may be incorporated into the polymer to make the overcoat UV absorptive, thus protecting the image from UV induced fading. Other compounds may be added to the coating composition, depending on the functions of the particular layer, including surfactants, emulsifiers, coating aids, lubricants, matte particles, rheology modifiers, crosslinking agents, antifoggants, inorganic fillers such as conductive and nonconductive metal oxide particles, pigments, magnetic particles, biocide, and the like. The coating composition may also include a small amount of organic solvent, preferably the concentration of organic solvent is less than 5 percent by weight of the total coating composition.

Examples of coating aids include surfactants, viscosity modifiers and the like. Surfactants include any surface-active material that will lower the surface tension of the coating preparation sufficiently to prevent edge-withdrawal, repellencies, and other coating defects. These include alkyloxy- or alkylphenoxypolyether or polyglycidol derivatives and their sulfates, for example a nonylphenoxypoly (glycidol) such as Olin 10G™ available from Olin Matheson Corporation or sodium octylphenoxypoly(ethyleneoxide)-sulfate, organic sulfates or sulfonates, such as sodium dodecyl sulfate, sodium dodecyl sulfonate, sodium bis(2-ethylhexyl)sulfosuccinate, and alkylcarboxylate salts such as sodium decanoate.

The surface characteristics of the overcoat are in large part dependent upon the physical characteristics of the polymers. However, the surface characteristics of the overcoat also can be modified by the conditions under which the surface is optionally fused. For example, in contact fusing, the surface characteristics of the fusing element that is used to fuse the polymers to form the continuous overcoat layer can be selected to impart a desired degree of smoothness, texture or pattern to the surface of the element. Thus, a highly smooth fusing element will give a glossy surface to the imaged element, a textured fusing element will give a matte or otherwise textured surface to the element, a patterned fusing element will apply a pattern to the surface of the element, etc.

Matte particles well known in the art may also be used in the coating composition of the invention, such matting agents have been described in *Research Disclosure* No. 308119, published December 1989, pages 1008 to 1009. When polymer matte particles are employed, the polymer may contain reactive functional groups capable of forming covalent bonds with the binder polymer by intermolecular crosslinking or by reaction with a crosslinking agent in order to promote improved adhesion of the matte particles to the coated layers. Suitable reactive functional groups include hydroxyl, carboxyl, carbodiimide, epoxide, aziridine, vinyl sulfone, sulfinic acid, active methylene, amino, amide, allyl, and the like.

In order to reduce the sliding friction of the photographic elements in accordance with this invention, the overcoat composition may contain fluorinated or siloxane-based components and/or the coating composition may also include lubricants or combinations of lubricants. Typical lubricants include (1) silicone based materials disclosed, for example, in U.S. Pat. Nos. 3,489,567, 3,080,317, 3,042,522, 4,004,927, and 4,047,958, and in British Patent Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc., disclosed in U.S. Pat. Nos. 2,454,043; 2,732,305; 2,976,148; 3,206,311; 3,933,516; 2,588,765; 3,121,060; 3,502,473; 3,042,222; and 4,427,964, in British Patent Nos. 1,263,722; 1,198,387; 1,430,997; 1,466,304; 1,320,757; 1,320,565; and 1,320,756; and in German Patent Nos. 1,284,295 and 1,284,294; (3) liquid paraffin and paraffin or wax like materials such as carnauba wax, natural and synthetic waxes, petroleum waxes, mineral waxes, silicone-wax copolymers and the like; (4) perfluoro- or fluoro- or fluorochloro-containing materials, which include poly(tetrafluoroethylene), poly (trifluorochloroethylene), poly(vinylidene fluoride, poly (trifluorochloroethylene-co-vinyl chloride), poly(meth) acrylates or poly(meth)acrylamides containing perfluoroalkyl side groups, (5) polyethylene, and the like. Lubricants useful in the present invention are described in further detail in *Research Disclosure* No.308119, published December 1989, page 1006.

The coating composition of the invention is advantageously applied simultaneously with the underlying layers of the imaging element for ease of manufacture. However, it is also possible to apply the overcoat separately by any of a number of well known techniques, such as dip coating, rod coating, blade coating, air knife coating, gravure coating and reverse roll coating, extrusion coating, slide coating, curtain coating, and the like. After coating, the layer is generally dried by simple evaporation, which may be accelerated by known techniques such as convection heating. Known coating and drying methods are described in further detail in *Research Disclosure* No. 308119, Published December 1989, pages 1007 to 1008.

The laydown of the overcoat will depend on its field of application. For a photographic element, the total dry laydown is suitably 50 to 600 mg/ft$^2$, most preferably 100 to 300 mg/ft$^2$. It may be advantageous to increase the amount of gelatin in the overcoat as the laydown increases in order to improve the developability. The higher the laydown of the hydrophobic polymer component, the better the water resistance. On the other hand, increasing the laydown of hydrophobic particles, at some point, may tend to slow down the photographic development.

After applying the coating composition to the support, it may be dried over a suitable period of time, for example 2 to 4 minutes.

Photographic elements of this invention can differ widely in structure and composition. For example, the photographic elements can vary greatly with regard to the type of support, the number and composition of the image-forming layers, and the number and types of auxiliary layers that are included in the elements. In particular, photographic elements can be still films, motion picture films, x-ray films, graphic arts films, paper prints or microfiche. It is also specifically contemplated to use the conductive layer of the present invention in small format films as described in *Research Disclosure,* Item 36230 (June 1994). Photographic elements can be either simple black-and-white or monochrome elements or multilayer and/or multicolor elements adapted for use in a negative-positive process or a reversal process. Generally, the photographic element is prepared by coating one side of the film or paper support with one or more layers comprising a dispersion of silver halide crystals in an aqueous solution of gelatin and optionally one or more subbing layers. The coating process can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in *Research Disclosure,* Vol. 176, Item 17643 (December 1978).

Imaging elements protected in accordance with this invention can be derived from silver halide photographic elements that can be black and white elements (for example, those which yield a silver image or those which yield a neutral tone image from a mixture of dye forming couplers), single color elements or multicolor elements. Multicolor elements typically contain dye image-forming units sensitive to each of the three primary regions of the spectrum. The imaged elements can be imaged elements which are viewed by transmission, such a negative film images, reversal film images and motion picture prints or they can be imaged elements that are viewed by reflection, such as paper prints. Because of the amount of handling that can occur with paper prints and motion picture prints, they are the preferred photographic imaging elements according to the present invention.

The photographic elements in which the images to be protected are formed can have the structures and components shown in Research Disclosure 37038 and 38957. Specific photographic elements can be those shown on pages 96–98 of Research Disclosure 37038 as Color Paper Elements 1 and 2. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler.

The element can contain additional layers, such as filter layers, interlayers, overcoat layers, subbing layers, and the like. All of these can be coated on a support which can be transparent (for example, a film support) or reflective (for example, a paper support). Support bases that can be used include both transparent bases, such as those prepared from polyethylene terephthalate, polyethylene naphthalate, cellulosics, such as cellulose acetate, cellulose diacetate, cellulose triacetate, and reflective bases such as paper, coated papers, melt-extrusion-coated paper, and laminated papers, such as those described in U.S. Pat. Nos. 5,853,965; 5,866,282; 5,874,205; 5,888,643; 5,888,681; 5,888,683; and 5,888,714. Photographic elements protected in accordance with the present invention may also include a magnetic recording material as described in *Research Disclosure,* Item 34390, November 1992, or a transparent magnetic recording layer such as a layer containing magnetic particles on the underside of a transparent support as described in U.S. Pat. Nos. 4,279,945 and U.S. Pat. No. 4,302,523.

Suitable silver halide emulsions and their preparation, as well as methods of chemical and spectral sensitization, are described in Sections I through V of Research Disclosure 37038 (or 38957). Color materials and development modifiers are described in Sections V through XX of Research Disclosure 37038. Vehicles are described in Section II of Research Disclosure 37038, and various additives such as brighteners, antifoggants, stabilizers, light absorbing and scattering materials, hardeners, coating aids, plasticizers, lubricants and matting agents are described in Sections VI through X and XI through XIV of Research Disclosure 37038. Processing methods and agents are described in Sections XIX and XX of Research Disclosure 37038, and methods of exposure are described in Section XVI of Research Disclosure 37038.

Photographic elements typically provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like). Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like.

Photographic elements can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, CRTs, etc.).

Images can be developed in photographic elements in any of a number of well known photographic processes utilizing any of a number of well known processing compositions, described, for example, in T. H. James, editor, *The Theory of the Photographic Process,* 4th Edition, Macmillan, N.Y., 1977. In the case of processing a color negative element, the element is treated with a color developer (that is one which will form the colored image dyes with the color couplers), and then with an oxidizer and a solvent to remove silver and silver halide. In the case of processing a color reversal element or color paper element, the element is first treated with a black and white developer (that is, a developer which does not form colored dyes with the coupler compounds) followed by a treatment to render developable unexposed silver halide (usually chemical or light fogging), followed by treatment with a color developer. Development is followed by bleach-fixing, to remove silver or silver halide, washing and drying.

In one embodiment of a method of using a composition according to the present invention, a photographic element may be provided with a processing-solution-permeable overcoat having the above described composition overlying the silver halide emulsion layer superposed on a support. The photographic element is developed in an alkaline developer solution having a pH greater than 7, preferably greater than 8, more preferably greater than 9. This allows the developer to penetrate the protective coating.

The overcoat layer in accordance with this invention is particularly advantageous for use with photographic prints due to superior physical properties including excellent resistance to water-based spills, fingerprinting, fading and yellowing, while providing exceptional transparency and toughness necessary for providing resistance to scratches, abrasion, blocking, and ferrotyping.

The polymer overcoat may be further coalesced by fusing (heat and/or pressure) if needed after processing without substantial change or addition of chemicals in the processing step to form a fully water impermeable protective overcoat with excellent gloss characteristics. Optional fusing may be carried out at a temperature of from 35 to 175 ° C.

The present invention is illustrated by the following Examples.

EXAMPLES

Characterizations of polymeric materials in the following examples were obtained by the following tests or analytical techniques:

Glass Transition Temperature and Melting Temperature

Both glass transition temperature (Tg) and melting temperature (Tm) of the dry polymer material were determined by differential scanning calorimetry (DSC), using a ramping rate of 20 C/minute. Tg is defined herein as the inflection point of the glass transition and Tm is defined herein as the peak of the melting transition.

Particle Size Measurement

All particles were characterized by Photon Correlation Spectroscopy using a Zetasizer Model DTS5100 manufactured by Malvern Instruments.

Average Molecular Weight

The samples were analyzed by size-exclusion chromatography in tetrahydrofuran using three Polymer Laboratories P1gel™ mixed-C columns. The column set was calibrated with narrow-molecular-weight distribution polystyrene standards between 595 (log M=2.76) and 2170000 (log M=6.34) daltons. Number average molecular weight and polydispersity (defined as the ratio of weight average molecular weight and number average molecular weight) were reported.

Preparation of polymeric materials in the following examples were obtained by the following synthetic methods.

Preparation of P1 (Butyl Acrylate Latex)

To a 1L three-necked reaction flask fitted with a stirrer and condenser were added 300 ml of degassed distilled water, 2 ml of 45% Dowfax™2A1, 1.00 g of potassium persulfate, and 0.33 g of sodium metabisulfite. The flask was placed in a 60 C bath and the contents of an addition flask containing 100 ml of distilled water, 2 ml of 45% Dowfax™2A1, 95 g of n-butyl mehacrylate and 5 g of 2-sulfo-1,1-dimethylethyl acrylamide (sodium salt) was added to the reaction flask over a period of 40 minutes. The reaction flask was stirred at 80 C for 1 hour and 0.25 g of potassium persulfate was added and the contents stirred at 80 C for additional 90 minutes. The flask was cooled and the pH of the latex was adjusted to 5.5 using 10% sodium hydroxide to give a latex containing 20% solids. The Tg of the polymer was 35 C.

Preparation of P2 (Ethyl Acrylate/Vinylidene Chloride/Hydroxyethyl Acrylate (10/88/2))

To a 20-ounce polyethylene bottle was added 341 g of demineralized water. The water was purged for 15–20 minutes with nitrogen. The following were added to the reactor in order: 5.10 g 30% Triton™770, 3.06 g hydroxyethyl acrylate, 15.29 g ethyl acrylate, 134.59 g vinylidene chloride, 0.7586 g potassium metabisulfite, and 0.3794 g potassium persulfate. The bottle was capped and placed in a tumbler bath at 40° C., and held there for 16–20 hours. The product was then removed from the bath, and cooled to 20° C. The product was filtered through cheesecloth. Glass transition temperature was 9° C. as measured by DSC, average particle size obtained from PCS was 75 nm.

Preparation of P3 (aqueous polyurethane dispersion)

In a 1 liter resin flask equipped with thermometer, stirrer, water condenser and a vacuum outlet, was placed 294 g (0.28 mole) of dry Pluracol P1010™ poly(propylene glycol, Mw=1000), 40.20 g (0.30 mole) dimethylol propionic acid, 225 g (0.67 mole) 4,4'-hexafluoroisoproylidene diphenol, 278 g (1.25 mole) isophorone diisocyanate and 1 liter of dry ethyl acetate. The temperature was adjusted to 75 C. When a homogeneous solution was obtained, 25 g of dibutlyltin dilaurate (catalyst) was slowly added while stirring. The mixture was maintained for about 20 hours. Then, a stoichometric amount of potassium hydroxide based on dimethylol propionic acid was added, followed by 3% by weight of Aerosol™OT (sodium dioctyl sulfosuccinate) and maintained for 10 min. This was mixed with 4 liters of distilled water under high shear to form a stable aqueous dispersion. Ethyl acetate was removed by heating under vacuum to give an aqueous dispersion at 20.1% solids. The glass transition temperature was 39.4 C as measured by DSC, and the weight average molecular weight was 22,800.

Preparation of P4 (aqueous polyurethane dispersion)

In a 1 liter resin flask equipped with thermometer, stirrer, water condenser and a vacuum outlet, 75.68 g (0.088 mole) polycarbonate polyol KM101733 (Mw=860) was melted and dewatered under vacuum at 100 C. The vacuum was released and at 40 C was added 10.25 g (0.076 mole) of dimethylol propionic acid, 30.28 g (0.336 mole) of 1,4-butanediol, 75 g of tetrahydrofuran and 15 drops of dibutyltin dilaurate (catalyst) while stirring. The temperature was adjusted to 75 C. When a homogeneous solution was obtained, 111.28 g (0.50 mole) isophorone diisocyanate was slowly added, followed by 25 g tetrahydrofuran. The mixture was maintained for about 4 hours to complete the reaction. The NCO (isocyanate determined by IR analysis) was substantially nil. A stoichiometric amount of potassium hydroxide based on dimethylol propionic acid was stirred in and maintained for 5 min. This was mixed with 1300 g of water under high shear to form a stable aqueous dispersion. Tetrahydrofuran was removed by heating under vacuum to give an aqueous dispersion at 19.11% solids. The glass transition temperature was 52.6 C as measured by DSC, and the weight average molecular weight was 11,000.

Preparation of P5 (Methyl Methacrylate Latex)

P5 was prepared identically to P1 above, except using methyl methacrylate instead of butyl acrylate. The Tg of the polymer was 120 C.

Preparation of P6 (aqueous polyurethane dispersion)

P6 is prepared the same as polymer P4 above except 10 g (0.094 mole) of diethylene glycol is substituted for an equal amount of 1,4-butanediol as a chain extender. Tetrahydrofuran was removed by heating under vacuum to give an aqueous dispersion at 16.91% solids. The glass transition temperature was 47.1 C as measured by DSC, and the weight average molecular weight was 23,900.

Source of Wax-1

Jonwax™26 wax, an aqueous dispersion of high density polyethylene wax particles, was purchased from SC Johnson at 25% solids and used as received. The melting point of this wax was 130° C. and the average particle size was 58 mn.

Source of Protease Enzymes:

Protex 6L™ enzyme was purchased from Genenco, liquid, and used as received. Esperase™ enzyme 8.0L was purchased from Novo Nordisk, Inc., liquid, and used as received. HT-Proteolytic 200™ enzyme was purchased from Genencor International, Inc., powder, and used as received.

Enzyme Solution #1 consisted of 0.8% Protex™6L (purchased from Genenco) in deionized water, pH of the solution was adjusted to 10 by Sodium carbonate and sodium bicarbonate.

Enzyme Solution #2 consisted of 0.2% Esperase™8.0L (purchased from Novo Nordisk, Inc.) in deionized water, pH of the solution was adjusted to 10 by sodium carbonate and sodium bicarbonate.

Enzyme Solution #3 consisted of 2% HT-Proteolytic™200 (purchased from Genencor International, Inc.) in deionized water, pH of the solution was adjusted to 7.5 by sodium hydroxide.

Preparation of the Photographic Sample

Sample 1 (the check for Sample 2, 3, and 4 in Example1) was prepared by coating in sequence a blue-light sensitive layer, an interlayer, a green-light sensitive layer, a UV layer, a red-light sensitive layer, a UV layer and an overcoat on photographic paper support. The components in each individual layer are described below.

| Layer | Item | Laydown (mg/ft$^2$) |
|---|---|---|
| Layer 1 | Blue Sensitive Layer | |
| | Gelatin | 121.90 |
| | Blue-light sensitive AgX | 21.10 |
| | Y-1 | 38.50 |
| | Di-n-butyl phthalate | 17.33 |
| | ST-23 | 38.50 |
| | ST-16 | 0.88 |
| | Benzenesulfonic acid, 2,5-dihydroxy-4-(1-methylheptadecyl)-,monopotassium salt | 0.88 |
| | 1-Phenyl-5 -mercaptotetrazole | 0.013 |
| Layer 2 | Interlayer | |
| | Gelatin | 70.00 |
| | ST-4 | 6.13 |
| | Di-n-butyl phthalate | 17.47 |
| | Disulfocatechol disodium | 6.00 |
| | Nitric acid | 0.524 |
| | SF-1 | 0.18 |
| Layer 3 | Green Sensitive Layer | |
| | Gelatin | 132.00 |
| | Green-light sensitive AgX | 7.30 |
| | M-1 | 22.10 |
| | Di-n-butyl phthalate | 7.85 |
| | Diundecyl phthalate | 3.36 |
| | ST-1 | 16.83 |
| | ST-2 | 5.94 |
| | ST-3 | 56.09 |
| | 1-Phenyl-5-mercaptotetrazole | 0.05 |
| Layer 4 | UV Layer | |
| | Gelatin | 66.00 |
| | UV-1 | 15.98 |
| | UV-2 | 2.82 |
| | ST-4 | 5.14 |
| | Di-n-butyl phthalate | 3.13 |
| | 1,4-Cyclohexylenedimethylene bis(2-ethylhexanoate) | 3.13 |
| Layer 5 | Red Sensitive Layer | |
| | Gelatin | 126.0 |
| | Red-light sensitive AgX | 18.70 |

-continued

| Layer | Item | Laydown (mg/ft$^2$) |
|---|---|---|
| | C-1 | 35.40 |
| | Di-n-butyl phthalate | 34.69 |
| | 2-(2-Butoxyethoxy)ethyl acetate | 2.90 |
| | ST-4 | 0.29 |
| | UV-1 | 22.79 |
| | Silver phenyl mercaptotetrazole | 0.05 |
| | Benzenesulfonothioic acid, 4-methyl-, potassium salt | 0.26 |
| Layer 6 | UV Layer | |
| | Gelatin | 50.00 |
| | UV-1 | 12.11 |
| | UV-2 | 2.13 |
| | ST-4 | 3.90 |
| | Di-n-butyl phthalate | 2.37 |
| | 1,4-Cyclohexylenedimethylene bis(2-ethylhexanoate) | 2.37 |
| Layer 7 | Overcoat | |
| | Gelatin | 60.0 |
| | SF-1 | 1.00 |
| | SF-2 | 0.39 |
| | Bis(vinylsulfonyl)methane | 9.14 |

The Photographic paper support:

Sublayer 1: resin coat (Titanox and optical brightener in polyethylene)

Sublayer 2: paper

Sublayer 3: resin coat (polyethylene)

SF-1

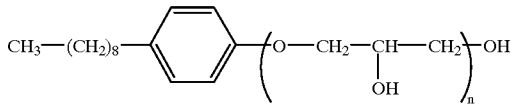

SF-2 $CF_3.(CH_2)_7.SO_3Na$

UV-1

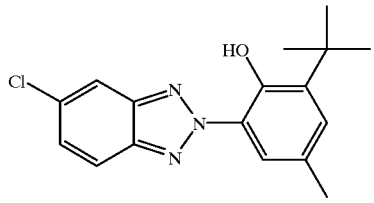

UV-2

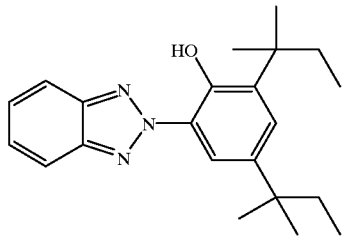

-continued

C-1

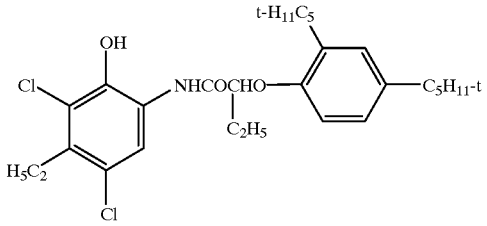

M-1

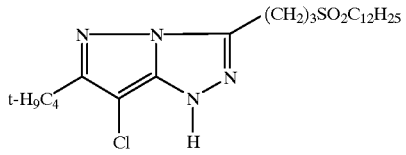

ST-1

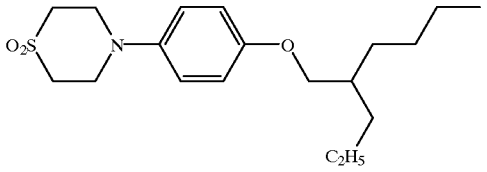

ST-2

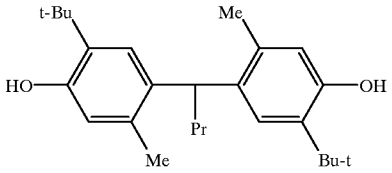

ST-3

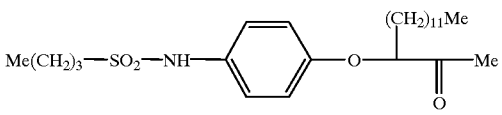

ST-4

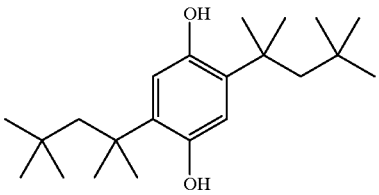

Y-1

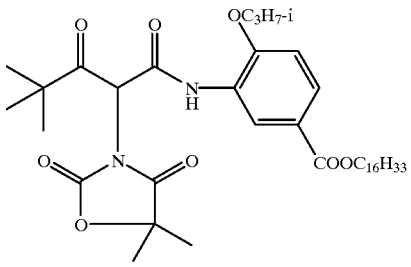

ST-16

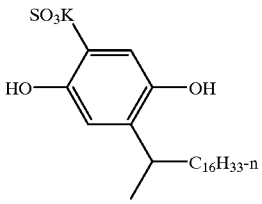

-continued

ST-23

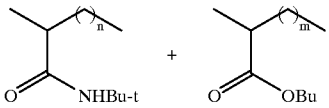

n:m = 1:1; MW = 75,000–100,000

Sample 5 (the check for Sample 6 to 10 in was prepared by coating in sequence a blue-light sensitive layer, an interlayer, a green-light sensitive layer, a UV layer, a red-light sensitive layer, a UV layer and an overcoat on photographic paper support. The components in each individual layer are described below.

Blue Sensitive Emulsion (Blue EM-1). A high chloride silver halide emulsion is precipitated by adding approximately equimolar silver nitrate and sodium chloride solutions into a well stirred reactor containing glutaryldiaminophenyldisulfide, gelatin peptizer and thioether ripener. Cesium pentachloronitrosylosmate(II) dopant is added during the silver halide grain formation for most of the precipitation, followed by the addition of potassium hexacyanoruthenate(II), potassium (5-methylthiazole)-pentachloroiridate, a small amount of KI solution, and shelling without any dopant. The resultant emulsion contains cubic shaped grains having edge length of 0.6 $\mu$m. The emulsion is optimally sensitized by the addition of a colloidal suspension of aurous sulfide and heat ramped to 60° C. during which time blue sensitizing dye BSD-4, potassium hexchloroiridate, Lippmann bromide and 1-(3-acetamidophenyl)-5-mercaptotetrazole were added.

Green Sensitive Emulsion (Green EM-1): A high chloride silver halide emulsion is precipitated by adding approximately equimolar silver nitrate and sodium chloride solutions into a well stirred reactor containing, gelatin peptizer and thioether ripener. Cesium pentachloronitrosylosmate (HI) dopant is added during the silver halide grain formation for most of the precipitation, followed by the addition of potassium (5-methylthiazole)-pentachloroiridate. The resultant emulsion contains cubic shaped grains of 0.3 $\mu$m in edgelength size. The emulsion is optimally sensitized by the addition of glutaryldiaminophenyldisulfide, a colloidal suspension of aurous sulfide and heat ramped to 55° C. during which time potassium hexachloroiridate doped Lippmann bromide, a liquid crystalline suspension of green sensitizing dye GSD-1, and 1-(3-acetamidophenyl)-5-mercaptotetrazole were added.

Red Sensitive Emulsion (ed EM-1): A high chloride silver halide emulsion is precipitated by adding approximately equimolar silver nitrate and sodium chloride solutions into a well stirred reactor containing gelatin peptizer and thioether ripener. During the silver halide grain formation, potassium hexacyanoruthenate(II) and potassium (5-methylthiazole)-pentachloroiridate are added. The resultant emulsion contains cubic shaped grains of 0.4 $\mu$m in edgelength size. The emulsion is optimally sensitized by the addition of glutaryldiaminophenyldisulfide, sodium thiosulfate, tripotassium bis {2-[3-(2-sulfobenzamido)phenyl]-mercaptotetrazole} gold(I) and heat ramped to 64° C. during which time 1-(3-acetamidophenyl)-5-mercaptotetrazole, potassium hexachloroiridate, and potassium bromide are added. The emulsion is then cooled to 40° C., pH adjusted to 6.0 and red sensitizing dye RSD-1 is added. Coupler dispersions were emulsified by methods well known in the art. The following imaging layers were coated in sequence on polyethylene-laminated photographic paper.

| Layer | Item | Laydown (mg/ft$^2$) |
|---|---|---|
| Layer 1 | Blue Sensitive Layer | |
| | Gelatin | 122.0 |
| | Blue sensitive silver (Blue EM-1) | 22.29 |
| | Y-4 | 38.49 |
| | ST-23 | 44.98 |
| | Tributyl Citrate | 20.24 |
| | ST-24 | 11.25 |
| | ST-16 | 0.883 |
| | Sodium Phenylmercaptotetrazole | 0.009 |
| | Piperidino hexose reductone | 0.2229 |
| | 5-chloro-2-methyl-4-isothiazolin-3-one/2-methyl-4-isothiazolin-3-one(3/1) | 0.019 |
| | SF-1 | 3.40 |
| | Potassium chloride | 1.895 |
| | Dye-1 | 1.375 |
| Layer 2 | Interlayer | |
| | Gelatin | 69.97 |
| | ST-4 | 9.996 |
| | Diundecyl phthalate | 18.29 |
| | 5-chloro-2-methyl-4-isothiazolin-3-one/2-methyl-4-isothiazolin-3-one(3/1) | 0.009 |
| | Catechol disulfonate | 3.001 |
| | SF-1 | 0.753 |
| Layer 3 | Green Sensitive Layer | |
| | Gelatin | 110.96 |
| | Green sensitive silver (Green EM-1) | 9.392 |
| | M-4 | 19.29 |
| | Oleyl Alcohol | 20.20 |
| | Diundecyl phthalate | 10.40 |
| | ST-1 | 3.698 |
| | ST-3 | 26.39 |
| | Dye-2 | 0.678 |
| | 5-chloro-2-methy1-4-isothiazo1in-3-one/2-methyl-4-isothiazolin-3-one(3/1) | 0.009 |
| | SF-1 | 2.192 |
| | Potassium chloride | 1.895 |
| | Sodium Phenylmercaptotetrazole | 0.065 |
| Layer 4 | M/C Interlayer | |
| | Gelatin | 69.97 |
| | ST-4 | 9.996 |
| | Diundecyl phthalate | 18.29 |
| | Acrylamide/t-Butylacrylamide sulfonate copolymer | 5.026 |

-continued

| Layer | Item | Laydown (mg/ft$^2$) |
|---|---|---|
| | Bis-vinylsulfonylmethane | 12.91 |
| | 3,5-Dinitrobenzoic acid | 0.009 |
| | Citric acid | 0.065 |
| | Catechol disulfonate | 3.001 |
| | 5-chloro-2-methyl-4-isothiazolin-3-one/2-methyl-4-isothiazolin-3-one(3/1) | 0.009 |
| Layer 5 | Red Sensitive Layer | |
| | Gelatin | 125.96 |
| | Red Sensitive silver (Red EM-1) | 17.49 |
| | IC-35 | 21.59 |
| | IC-36 | 2.397 |
| | UV-1 | 32.99 |
| | Dibutyl sebacate | 40.49 |
| | Tris(2-ethylhexyl)phosphate | 13.50 |
| | Dye-3 | 2.127 |
| | Potassium p-toluenethiosulfonate | 0.242 |
| | 5-chloro-2-methyl-4-isothiazolin-3-one/2-methyl-4-isothiazolin-3-one(3/1) | 0.009 |
| | Sodium Phenylmercaptotetrazole | 0.046 |
| | SF-1 | 4.868 |
| Layer 6 | UV Overcoat | |
| | Gelatin | 76.47 |
| | UV-2 | 3.298 |
| | UV-1 | 18.896 |
| | ST-4 | 6.085 |
| | SF-1 | 1.162 |
| | Tris(2-ethylhexyl)phosphate | 7.404 |
| | 5-chloro-2-methyl-4-isothiazolin-3-one/2-methyl-4-isothiazolin-3-one(3/1) | 0.009 |
| Layer 7 | SOC | |
| | Gelatin | 60.0 |
| | SF-1 | 1.0 |
| | SF-2 | 0.39 |
| | Bis(vinylsulfonyl)methane | 9.14 |

BSD-4

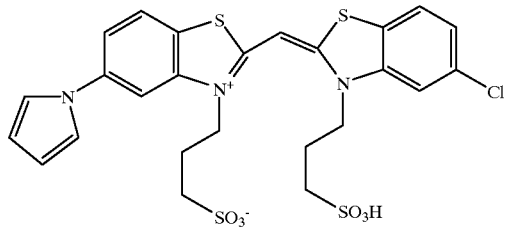

GSD-1

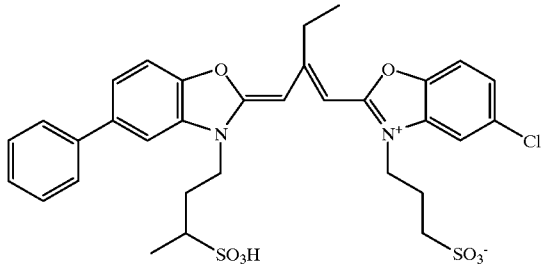

-continued
RSD-1
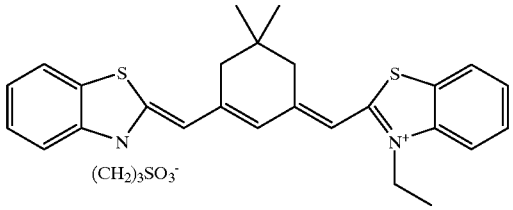
Y-4
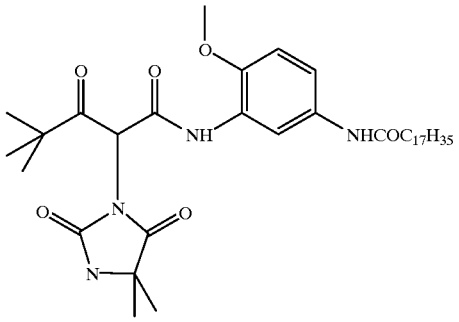
M-4
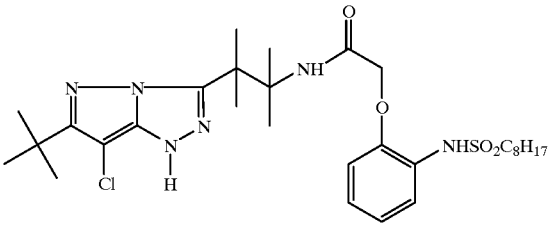
IC-35
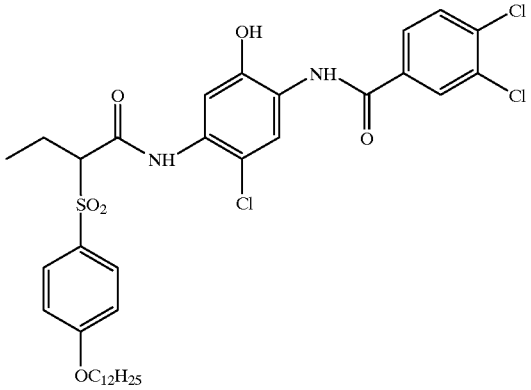

-continued
IC-36
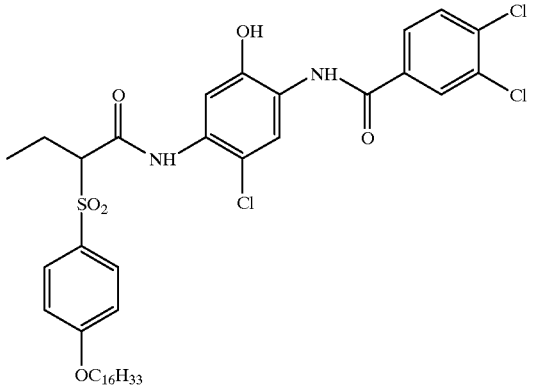
Dye-1
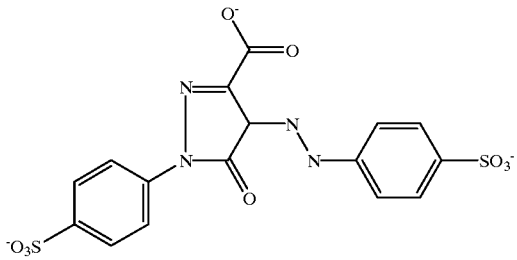
Dye-2
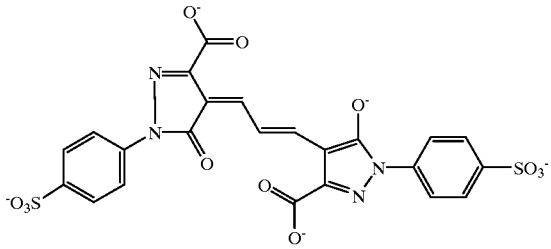
Dye 3
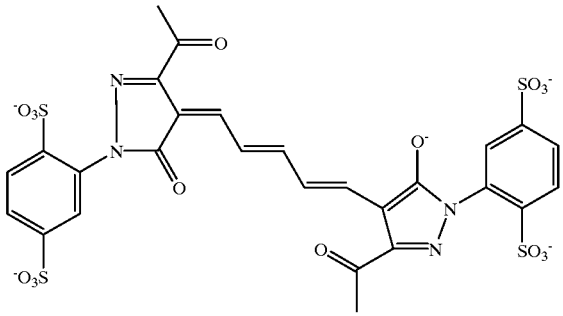
ST-1
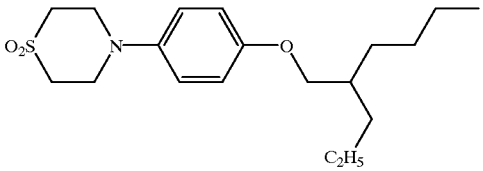
ST-3
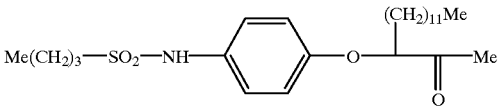

-continued
ST-4
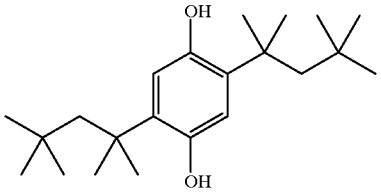
ST-16
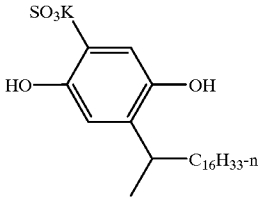
ST-23
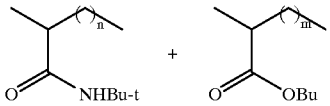
n:m = 1:1; MW = 75,000–100,000
ST-24
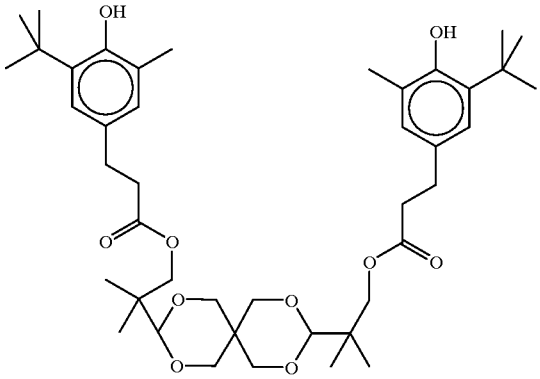
UV-1
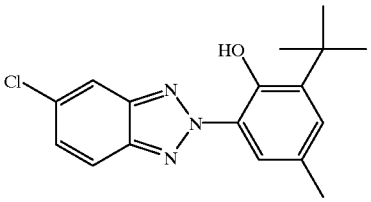
UV-2
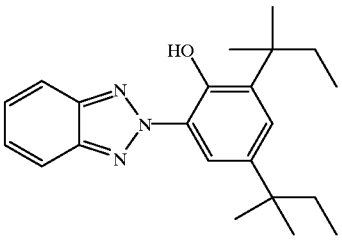
SF-1
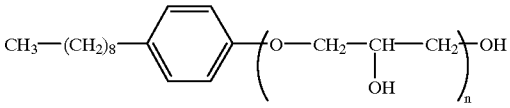
SF-2 $CF_3.(CH_2)_7.SO_3Na$ Standard RA-4 process steps and conditions:

| Solution/Step | Time (seconds) | Temperature (F.) |
|---|---|---|
| (1) Prime SP Developer | 45 | 100 |
| (2) Prime Bleach-Fix | 45 | 86–97 |
| (3) Prime Stabiliser | 90 | 86–99 |
| (4) Dry | As needed | Not to exceed 205 |

In Table 1 below, it is shown that samples processed through standard RA-4 process did not exhibit water resistance property regardless of the overcoat composition. However, after they were treated with enzyme, the overcoat that contained hydrophobic particles became water-resistant. The hydrophobic particles used in the examples vary widely from acrylic copolymer (P1), vinylidene chloride copolymer (P2) to polyurethane (P3).

TABLE 1

| Sample ID | Overcoat Composition (in mg/sq.ft.) | Type | Water resistance when processed by standard RA-4 | Water resistance after RA-4 processed with enzyme treatment as described above |
|---|---|---|---|---|
| 1 | 60 gelatin | comparison | No | No |
| 2 | 40 gelatin + 160 P1 | Invention | No | Yes |
| 3 | 40 gelatin + 160 P2 | Invention | No | Yes |
| 4 | 40 gelatin + 160 P3 | invention | No | Yes |

Fusing

Samples, as indicated below, were passed through a set of heated pressurized rollers at the preset temperature, pressure and speed.

The Testing of the Photographic Samples were conducted as follows:

Test for Water Resistance:

Ponceau Red dye is known to stain gelatin through ionic interaction. Ponceau red dye solution was prepared by dissolving 1 gram of dye in 1000 grams mixture of acetic acid and water (5 parts: 95 parts). Samples were soaked in the dye solution for 5 minutes followed by a 30-second water rinse to removed excess dye solution on the coating surface, then air dried. A sample with a good water-resistant protective layer does not change in appearance by this test. Samples showed very dense red color if there was no protective overcoat formed on the surface or the formation of the protective overcoat layer is imperfect.

Example 1

Sample 1 (the check) was prepared in the dark as described in the previous section. Samples 2 to 4 according to the invention were prepared identically to Sample 1, except with the difference in overcoat composition as indicated in Table 1. All samples were incubated in 90 F/50% RH (relative humidity) condition for 1 day to accelerate crosslinking of gelatin prior to photographic process. Each sample was processed by the standard Kodak RA-4 process (see Experimental section for details) to form a white image. Immediately following standard RA-4, samples were soaked in an Enzyme Solution #1 for 30 seconds at 37 C, then rinsed with tap water for 3 minutes, and then dried at 60 C for 15 minutes. Only Sample 3 was fused (at 300 F) prior to the water resistance test. Fusing was preferred for the convenience of short operation time, but can also be substituted by drying at 60 C for 45 minutes.

All samples were also exposed to red, green and blue lights and then RA-4 processed to generate cyan, magenta and yellow image. The samples having an overcoat of this invention (Samples 2, 3, and 4) produced satisfactory images as the comparison Sample 1 (the check). It is also worth pointed out that all these samples were not water-resistant if they were processed, dried and fused, without any enzyme treatment. Therefore, enzyme treatment is absolutely critical for the conversion of the water-permeable overcoat to the water-resistant protective overcoat.

Example 2

Sample 6 was prepared in the dark identically to Sample 5 (the Check), except with the difference in overcoat composition according to the present invention as described in Table 2 below. Sample 5 along with Sample 1 were incubated in 90 F/50% RH condition for 1 day to accelerate crosslinking of gelatin prior to photographic process. Both samples were processed by Kodak RA-4 processor HOPE™3026 using Kodak RA-4 process solutions, except with the modification of 0.4% Protex™6L added to the Kodak Ektacolor™ Prime Stabiliser solution (8 grams Protex™6L added to 2 liters Kodak Ektacolor™ Prime Stabiliser solution). Both coatings were tested for water resistance after processing and drying.

TABLE 2

| Sample ID | Overcoat Composition (in mg/sq.ft.) | Type | Water resistance when processed by standard RA-4 | Water resistance when RA-4 processed with enzyme in Kodak Prime Stabiliser solution |
|---|---|---|---|---|
| 5 | 60 gelatin | Comparison | No | No |
| 6 | 40 gelatin + 160 P4 | Invention | No | Yes |

As shown in this example, the protease enzyme can be easily added to the last step of RA-4 process and convert overcoat of this invention to a water-resistant protective overcoat layer after processing and drying.

Example 3

Samples 6 to 10 were prepared in the dark identically to Sample 5 (the Check), except with the difference in overcoat composition as described in Table 3 below. All samples were incubated in 90 F/50% RH condition for 1 day to accelerate crosslinking of gelatin prior to photographic process. All samples were processed by the standard Kodak RA-4 process (see Experimental section for details) to form white image. Immediately following standard RA-4 processing, samples were soaked in Enzyme Solution #1 for 30 seconds at 37 C, then rinsed with tap water for 3 minutes, and then dried at 60 C for 15 minutes. Coatings were tested for water resistance after processing and drying.

TABLE 3

| Sample ID | Overcoat Composition (in mg/sq.ft.) | Type | Water resistance when processed by standard RA-4 | Water resistance after processed with enzyme as described above |
|---|---|---|---|---|
| 5 | 60 gelatin | Comparison | No | No |
| 6 | 40 gelatin + 160 P4 | Invention | No | Yes |
| 7 | 40 gelatin + 130 P4 + 30 P5 | Invention | No | Yes |
| 8 | 40 gelatin + 150 P4 + 10 Wax-1 | Invention | No | Yes |
| 9 | 60 gelatin + 160 P4 | Invention | No | Yes |
| 10 | 30 gelatin + 120 P4 | Invention | No | Yes |

As shown in Table 3, the hydrophobic particles used in the overcoat can a combination of more than one type of particles (such as Sample 7), in combination with wax particles (such as Sample 8), at a different ratio to gelatin (such as Sample 9), or at a different laydown (such as Sample 10), to modify the physical properties of the layer prior to processing, during processing, or after processing. The water-resistance property after enzyme treatment is still retained in all cases.

Example 4

Sample 11 was prepared in the dark identically to Sample 5 (the Check), except with the difference in overcoat composition as described in Table 4 below. Samples 5 and 11 were incubated at 90 F and 50% RH for 1 day to accelerate crosslinking of gelatin prior to the photographic process. Both samples were processed by the standard Kodak RA-4 process (see Experimental section for details) to form white image, except with the modification of 1.5% Protex™6L added to the Kodak Ektacolor™ Prime Bleach-fix solution (30 grams Protex™6L added to 2 liters Kodak Ektacolor™ Prime Bleach-Fix solution). Both coatings were tested for water resistance after processing and drying.

TABLE 4

| Sample ID | Overcoat Composition (in mg/sq.ft.) | Type | Water resistance when processed by standard RA-4 | Water resistance-after RA-4 processed with enzyme in Bleach-fix solution as described above |
|---|---|---|---|---|
| 5 | 60 gelatin | Comparison | No | No |
| 11 | 40 gelatin + 160 P6 | Invention | No | Yes |

This example demonstrates that protease enzyme can be incorporated in the bleach-fix solution of the RA-4 process to convert the overcoat of this invention to a water-resistant protective overcoat.

Example 5

Sample 5 (the Check) and Sample 6 (according to the present invention) were incubated at 90 F and 50% RH for I day to accelerate crosslinking of gelatin prior to photographic processing. Both samples were processed by the standard Kodak RA-4 process (see Experimental section for details) to form a white image, except with the modification of 0.8% Protex™6L added to the Kodak Ektacolor™ Prime Developer solution (16 grams Protex™6L added to 2 liters Kodak Ektacolor™ Prime Developer solution). Both coatings were tested for water resistance after processing and drying.

TABLE 5

| Sample ID | Overcoat Composition (in mg/sq.ft.) | Note | Water resistance when processed by standard RA-4 | Water resistance-after RA-4 processed with enzyme in Developer solution as described above |
|---|---|---|---|---|
| 5 | 60 gelatin | comparison | No | No |
| 6 | 40 gelatin + 160 P4 | Invention | No | Yes |

This example demonstrates that protease enzyme can be rated in the developer solution of the RA-4 process to convert the overcoat invention to a water-resistant protective overcoat.

Example 6

Sample 1 (the Check) and Sample 3 (according to the present invention) were incubated at 90 F and 50% RH condition for 1 day to accelerate crosslinking of gelatin prior to the photographic process. Both samples were processed by the standard Kodak RA-4 process (see Experimental section for details) to form white image. Immediately following standard RA-4, samples were treated with a variety of protease enzyme solutions (Enzyme Solution #1, Enzyme Solution #2, and Enzyme Solution #3) described above, then rinsed with tap water for 3 minutes, and then dried at 60 C for 15 minutes. After drying, Sample 3 was fused at 300 F prior to water resistance test. The overcoat compositions, enzyme treatment and the results from water-resistance test on the treated samples are compiled in Table 6 below.

TABLE 6

| Sample ID | Overcoat Composition (in mg/sq.ft.) | Type | Enzyme treatment after RA-4 process | Water resistance |
|---|---|---|---|---|
| 1 | 60 gelatin | comparison | No | No |
| 1 | 60 gelatin | comparison | Enzyme Solution #1, 37 C., 30 seconds | No |
| 3 | 40 gelatin + 160 P2 | comparison | No | No |
| 3 | 40 gelatin + 160 P2 | Invention | Enzyme Solution #1, 37 C., 30 seconds | Yes |
| 3 | 40 gelatin + 160 P2 | invention | Enzyme Solution #2, 37 C., 60 seconds | Yes |
| 3 | 40 gelatin + 160 P2 | invention | Enzyme Solution #3, 47 C., 30 seconds | Yes |

In Table 6 above, it is shown that samples processed through the standard RA4 process (without enzyme) did not exhibit water resistance regardless of the overcoat composition. The overcoat of this invention requires enzyme treatment to be converted to a water-resistant protective layer. It is also shown in Table 6 that protease enzymes can generally be used in this invention. The treatment condition, such as concentration, time, temperature, pH, etc. depends on the activity of the specific enzyme used, and the extent of crosslinking in gelatin.

What is claimed is:

1. A photographic element comprising:

a support;

a silver halide emulsion layer superposed on a side of said support;

a processing solution permeable protective overcoat comprising 10 to 50% gelatin and 50 to 90% by weight of hydrophobic water-insoluble particles, at least 50% percent of the particles comprising a polymer having a Tg of less than 55° C. and a weight average molecular weight under 100,000, such that the hydrophobic particles coalesce to form a continuous layer without fusing after the gelatin is enzymatically removed.

2. The photographic element of claim 1 wherein the overcoat further comprises UV absorbers, speed control dyes, surfactants, emulsifiers, coating aids, lubricants, matte particles, rheology modifiers, crosslinling agents for the gelatin, antifoggants, inorganic fillers, pigments, magnetic particles and/or biocides.

3. The imaging element of claim 1 further comprising an antistatic layer superposed on the support.

4. The imaging element of claim 1 further comprising a transparent magnetic layer superposed on the support.

5. The imaging element of claim 1 wherein the support is transparent.

6. The imaging element of claim 1 wherein the support is reflective.

7. The imaging element of claim 1 wherein the support is partially transparent and partially reflective.

8. The imaging element of claim 1 wherein the hydrophobic particles have a Tg between 0 and 50° C.

9. The imaging element of claim 1 wherein the hydrophobic particles have a weight average molecular weight between 5000 and 50,000.

* * * * *